US006036558A

United States Patent [19]

Sato et al.

[11] Patent Number: 6,036,558

[45] Date of Patent: Mar. 14, 2000

[54] OUTBOARD MOTOR

[75] Inventors: Takuya Sato, Hamamatsu; Yoshiaki Yuda, Shizuoka-Ken, both of Japan

[73] Assignee: Suzuki Kabushiki Kaisha, Hamamatsu, Japan

[21] Appl. No.: 09/018,532

[22] Filed: Feb. 4, 1998

[30] Foreign Application Priority Data

Feb. 5, 1997 [JP] Japan ..... 9-022991

[51] Int. Cl.[7] ..... B63H 20/24

[52] U.S. Cl. ..... 440/89; 440/76

[58] Field of Search ..... 440/88, 89, 76; 60/312, 314

[56] References Cited

U.S. PATENT DOCUMENTS 4,795,383 1/1989 Binversie et al. ..... 440/89

5,595,515 1/1997 Hasegawa et al. ..... 440/89

*Primary Examiner*—Sherman Basinger

*Attorney, Agent, or Firm*—Finnegan, Henderson, Farabow, Garrett & Dunner, L.L.P.

[57] ABSTRACT

An outboard motor generally comprises an engine holder to be mounted to a hull, an engine disposed in an upper portion of the engine holder in a mounted state thereof, an oil pan disposed in a lower portion of the engine holder, and a drive-shaft housing disposed below the oil pan and adapted to house a drive shaft of the engine, in which an exhaust gas from the engine is guided to the drive-shaft housing through an exhaust gas passage and the exhaust gas in the drive-shaft housing is discharged outward through an exhaust release passage connected to the drive-shaft housing at a time of low-speed revolution of the engine such as idling operation. There is further provided a partition wall integrally with an inside portion of the drive-shaft housing so as to divide the inside thereof into an expansion chamber communicated with the exhaust gas passage and a release chamber communicated with the exhaust release passage, and the partition wall has a cutout portion at an upper end portion thereof, through which the expansion chamber and the release chamber are communicated with each other.

6 Claims, 6 Drawing Sheets

OUTBOARD MOTOR

BACKGROUND OF THE INVENTION

The present invention relates to an outboard motor capable of achieving an improved noise reduction efficiency with a simple structure.

In general, an outboard motor has an underwater exhaust system. The underwater exhaust system has a structure that, for example, an exhaust tube is disposed in a drive-shaft housing of the outboard motor, the exhaust tube being, with bolts or the like, secured to a member, for example, an exhaust manifold, disposed at a portion upper than the drive-shaft housing in a state of the outboard motor being mounted to a hull. Thus, exhaust gas flowing -from an engine is discharged into the drive-shaft housing.

However, the bolts for securing the exhaust tube are easily corroded because the bolts is frequently immersed into or come in contact with sea water. Thus, there arises a problem in that the bolt is broken during a process for maintaining the outboard motor. What is worse, a multiplicity of parts, including washers, are required in addition to the bolts for securing the exhaust tube, thus causing a great labor to be required to assemble the outboard motor. As a result, the cost for manufacturing and maintaining the outboard motor cannot be reduced.

If the exhaust tube is individually disposed in the drive-shaft housing, a sufficiently large capacity cannot be obtained for the exhaust passage. Thus, a noise reduction effect has been improved by mixing exhaust cooling water for the engine with the exhaust gas. However, there arises a problem in that exhaust cooling water flows backward in the exhaust passage together with the exhaust gas if the pressure of the exhaust gas is raised attributable to a state of the operation of the outboard motor.

SUMMARY OF THE INVENTION

An object of the present invention is to substantially eliminate defects or drawbacks encountered in the prior art described above and to provide an outboard motor having a simple structure with reduced number of elements and capable of realizing an excellent noise or sound reduction effect.

Another object of the present invention is to provide an outboard motor which is capable of easily separating water contained in an exhaust gas.

These and other objects can be achieved according to the present invention by providing an outboard motor which comprises an engine holder to be mounted to a hull, an engine mounted on an upper portion of the engine holder in a mounted state thereof, an oil pan mounted to a lower portion of the engine holder, and a drive-shaft housing disposed below the oil pan and adapted to house a drive shaft of the engine, and in which an exhaust gas from the engine is guided to the drive-shaft housing through an exhaust gas passage and the exhaust gas in the drive-shaft housing is discharged outward through an exhaust release passage connected to the drive-shaft housing at a time of low-speed revolution of the engine such as in an idling operation, wherein a partition wall is formed integrally with an inside portion of the drive-shaft housing so as to divide the inside thereof into an expansion chamber communicated with the exhaust gas passage and a release chamber communicated with the exhaust release passage, the partition wall having a cutout portion at an upper end portion thereof, through which the expansion chamber and the release chamber are communicated with each other.

In a preferred embodiment, the release chamber is formed with an opening at a bottom portion thereof opened to the expansion chamber and a stepped portion inclined towards the opening is formed in the release chamber. The upper end portion of the partition wall abuts against a bottom portion of the oil pan.

In another aspect, the partition wall may section the inside of the drive-shaft housing into a main expansion chamber communicated with the exhaust gas passage, a release chamber, as an auxiliary expansion chamber, communicated with the exhaust release passage, and an overflow chamber, the partition wall having a gap, for example, cutout, portion at an upper end portion thereof, through which the main expansion chamber and the release chamber are communicated with each other.

In this aspect, the release chamber and the overflow chamber are formed with openings at bottom portions thereof opened to the expansion chamber and stepped portions inclined towards the openings are formed in the release chamber and the overflow chamber.

As described above, according to the present invention, there is provided the outboard motor having a structure that the exhaust gas flowing from an engine is introduced into a drive-shaft housing through the exhaust passage and the exhaust gas in the drive-shaft housing is discharged outward through the exhaust release passage when the engine is rotated at low speed. The outboard motor comprises a partition wall formed integrally with the inside portion of the drive-shaft housing so that the main expansion chamber is communicated with the exhaust passage and the release chamber as an auxiliary expansion chamber is communicated with the exhaust release passage, and the expansion chamber and the release chamber are communicated with each other through a gap, for example, cutout, portion formed to an upper end of the partition wall. As a result, the number of elements can be reduced for improving the noise reduction effect.

Since the opening is formed in the bottom of the release chamber so as to be opened to the main expansion chamber, and the stepped portion inclined toward the opening is formed in the release chamber, water contained in the exhaust gas can easily be separated.

The nature and further characteristic features of the present invention will be made more clear from the following description made with reference to the accompanying drawings.

DESCRIPTION OF THE PREFERRED EMBODIMENT

An embodiment of the present invention will be described hereunder with reference to the accompanying drawings.

Figure 1:
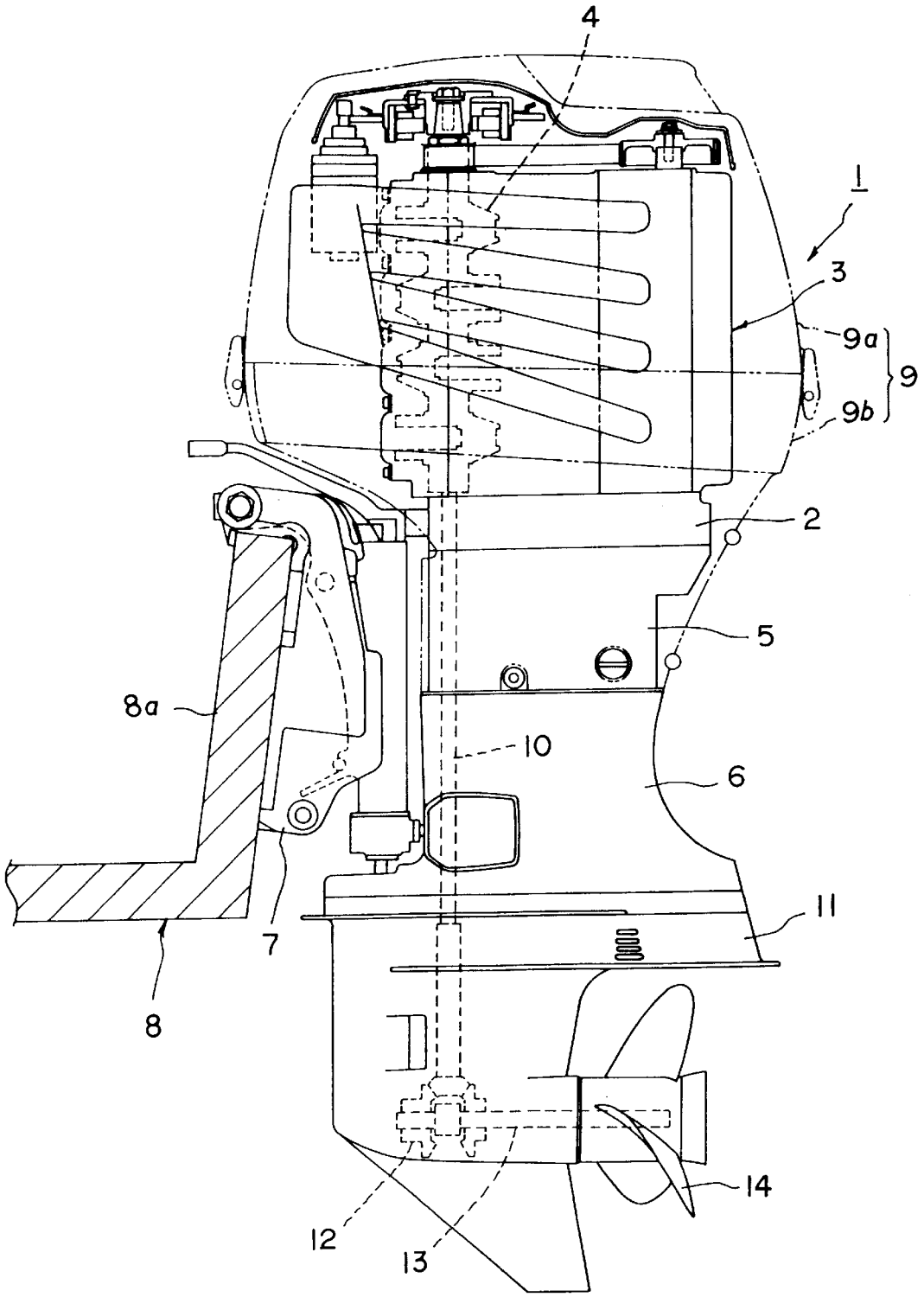
FIG. 1 is a left-hand side view showing an oil pump of an outboard motor according to an embodiment of the present invention.

FIG. 1 is a left-hand side view showing a preferred embodiment of an outboard motor, in a state mounted to a hull 8, according to the present invention. As shown in FIG. 1, the outboard motor 1 has an engine holder 2. An engine 3 is mounted on the upper portion of the engine holder 2. Moreover, a crank shaft 4 is vertically disposed in the engine 3 in such a manner that the crank shaft 4 extends in a substantially vertical direction. An oil pan 5 is disposed below the engine holder 2, while a drive-shaft housing 6 is disposed below the oil pan 5. The outboard motor 1 is mounted on a transom 8*a* of the hull 8 through the engine holder 2 and a crank shaft 7 joined to the drive-shaft housing 6.

An engine cover 9 is disposed to surround the engine 3. The engine cover 9 may be sectioned vertically into an upper cover section 9*a* and a lower section cover 9*b*. The lower cover section 9*b* is also sectioned laterally into a right portion and a left portion. The engine holder 2, the oil pan 5 and a lower portion of the engine 3 are covered with the lower cover section 9*b*, while the upper portion of the engine 3 is covered with the upper cover section 9*a*.

A drive shaft 10 of the engine connected to the lower end of the crank shaft 4 extends downward in the oil pan 5 and the drive-shaft housing 6. The drive shaft 10 rotates a propeller 14 through a bevel gear 12 and a propeller shaft 13 disposed in a gear case 11 disposed below the drive-shaft housing 6.

Figure 2:
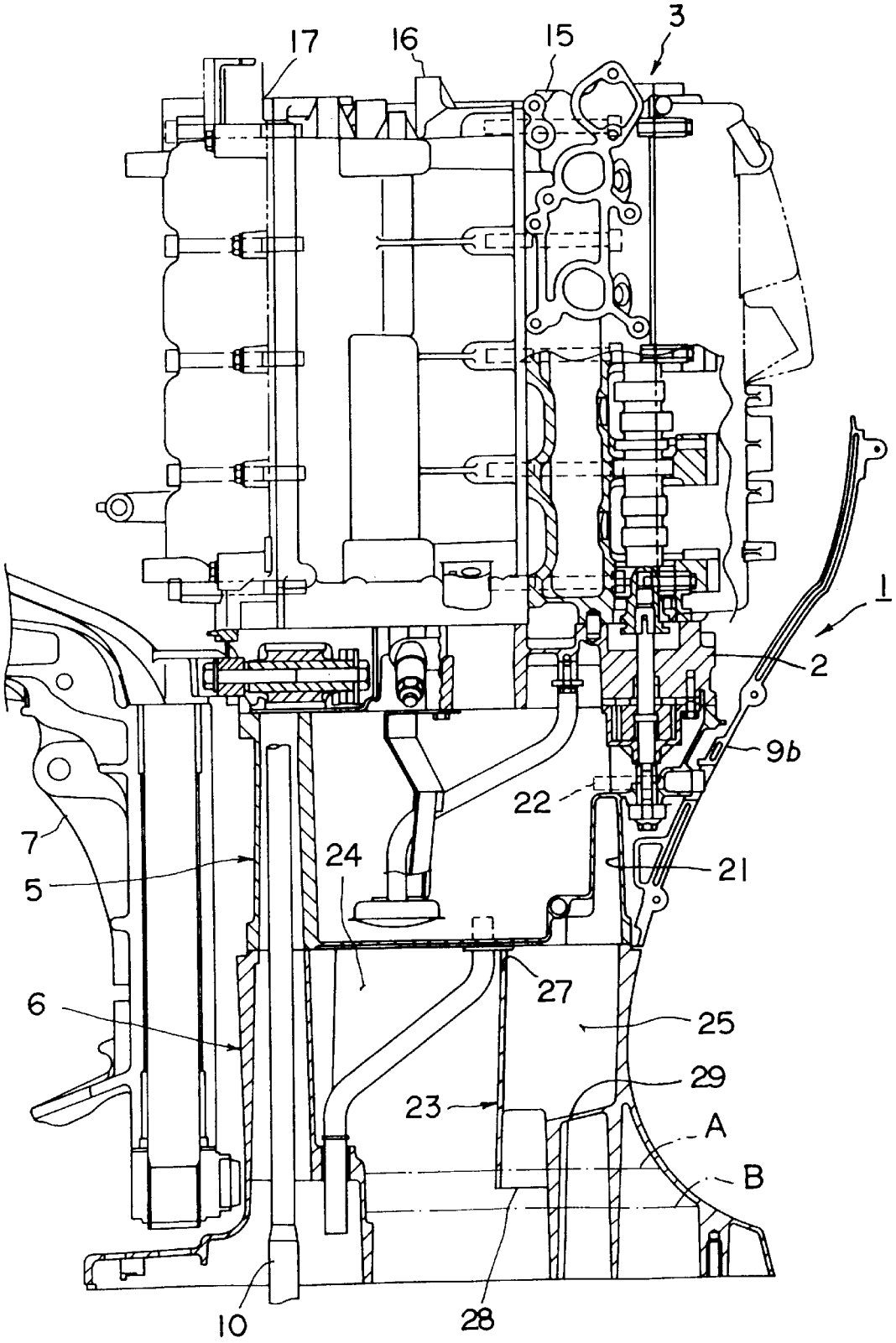
FIG. 2 is an enlarged left-hand side view showing an engine, an engine holder and an oil pan shown in FIG. 1.

FIG. 2 is an enlarged view showing the engine 3, engine holder 2 and the oil pan 5 shown in FIG. 1 in cross sections.

As shown in FIGS. 1 and 2, the engine 3 is, for example, a water-cooled and four-stroke-cycle engine having a cylinder head 15, a cylinder block 16, a crank case 17 and the like which are laid and disposed in the longitudinal direction of the hull 8. In this embodiment, the crank case 17 is disposed in the most front portion (adjacent to the hull 8) and the cylinder head 15 is disposed in the rearmost portion.

Figure 3:
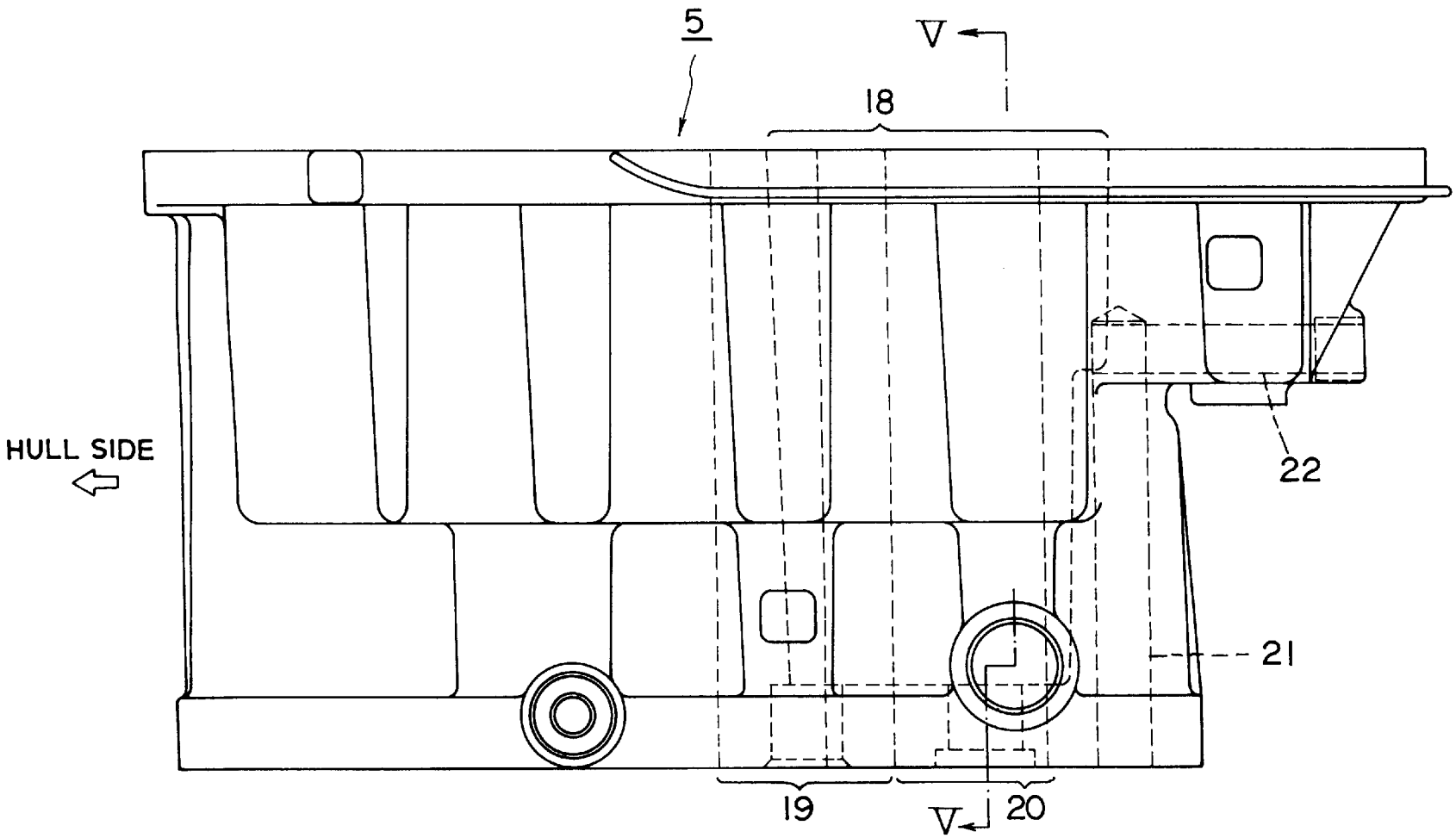
FIG. 3 is a left-hand side view showing the oil pan.
Figure 4:
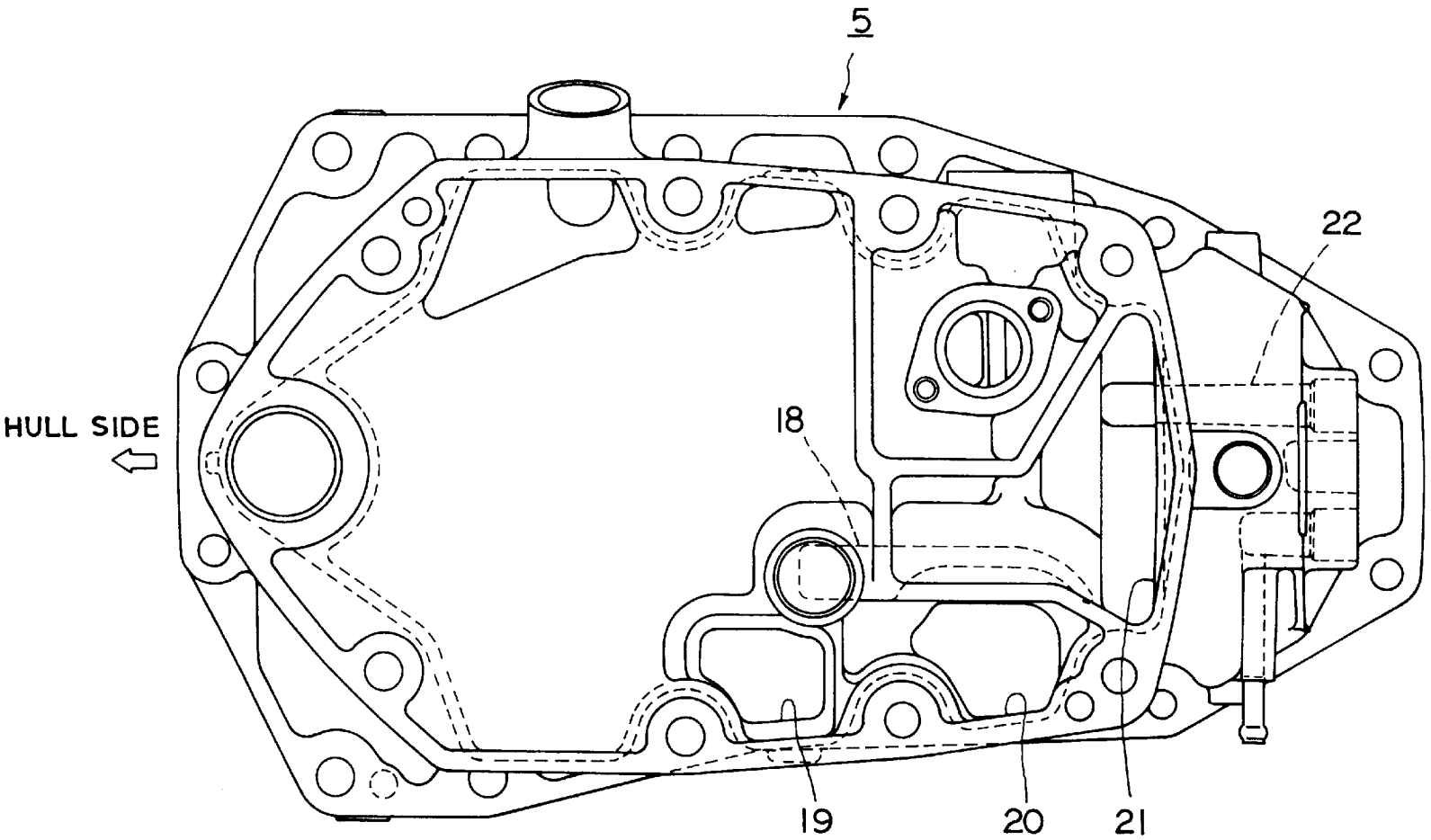
FIG. 4 is a bottom view showing the oil pan.
Figure 5:
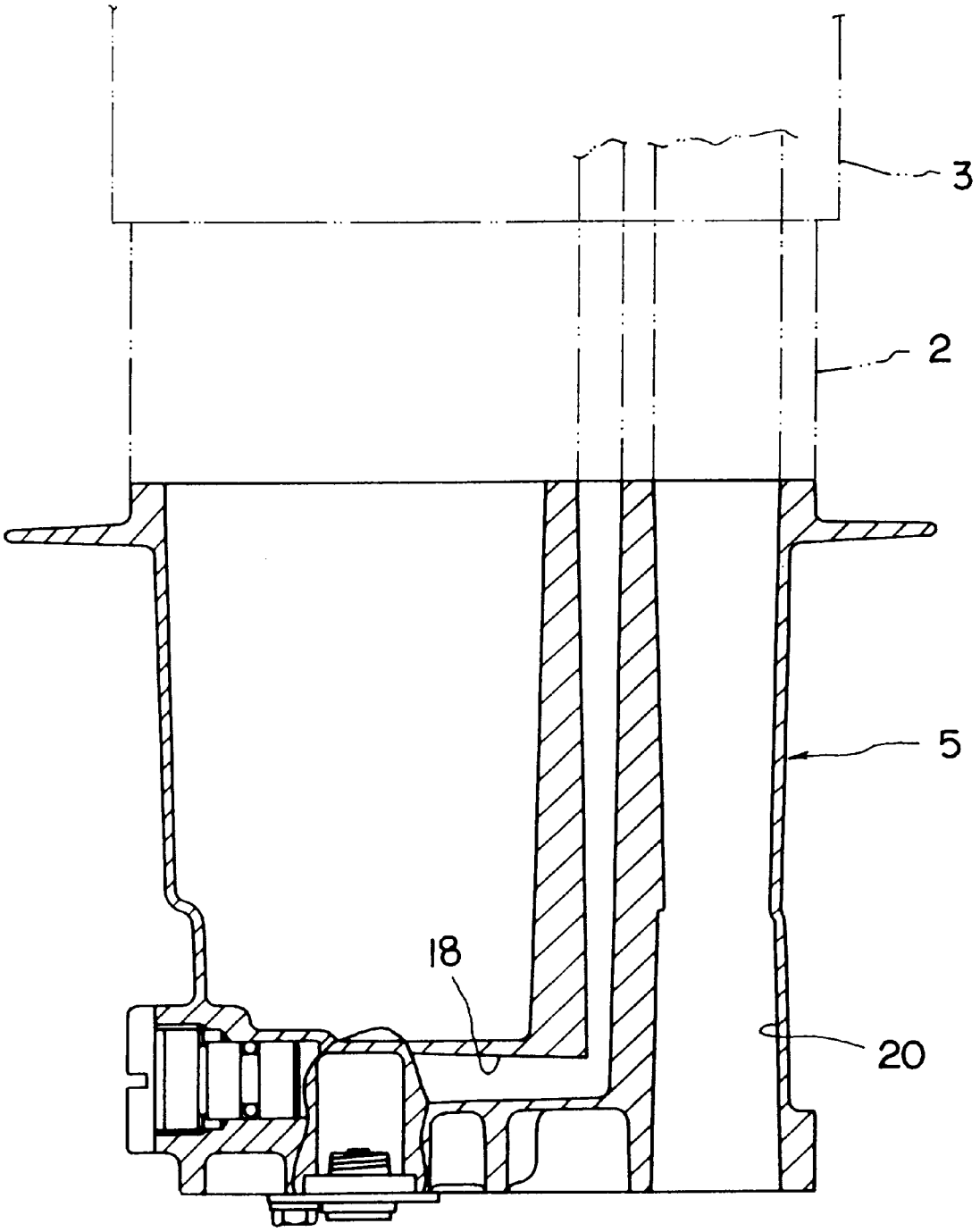
FIG. 5 is a cross sectional view taken along the line V—V shown in FIG. 3.

FIG. 3 is a left-hand side view showing the oil pan 5, FIG. 4 is a bottom view showing the oil pan 5. FIG. 5 is a cross sectional view taken along the line V—V shown in FIG. 3. As shown in FIGS. 3 to 5, a cooling-water supply passage 18, a cooling-water discharge passage 19 and an exhaust passage 20 are formed to vertically penetrate the inside portion of the oil pan 5. An exhaust release passage 21 extends upwards from the bottom surface of the oil pan 5 to reach an intermediate position of the oil pan 5. Moreover, an upper exhaust-gas discharge port 22 is extended from an end of the exhaust release passage 21 toward a rear portion of the oil pan 5.

Figure 6:
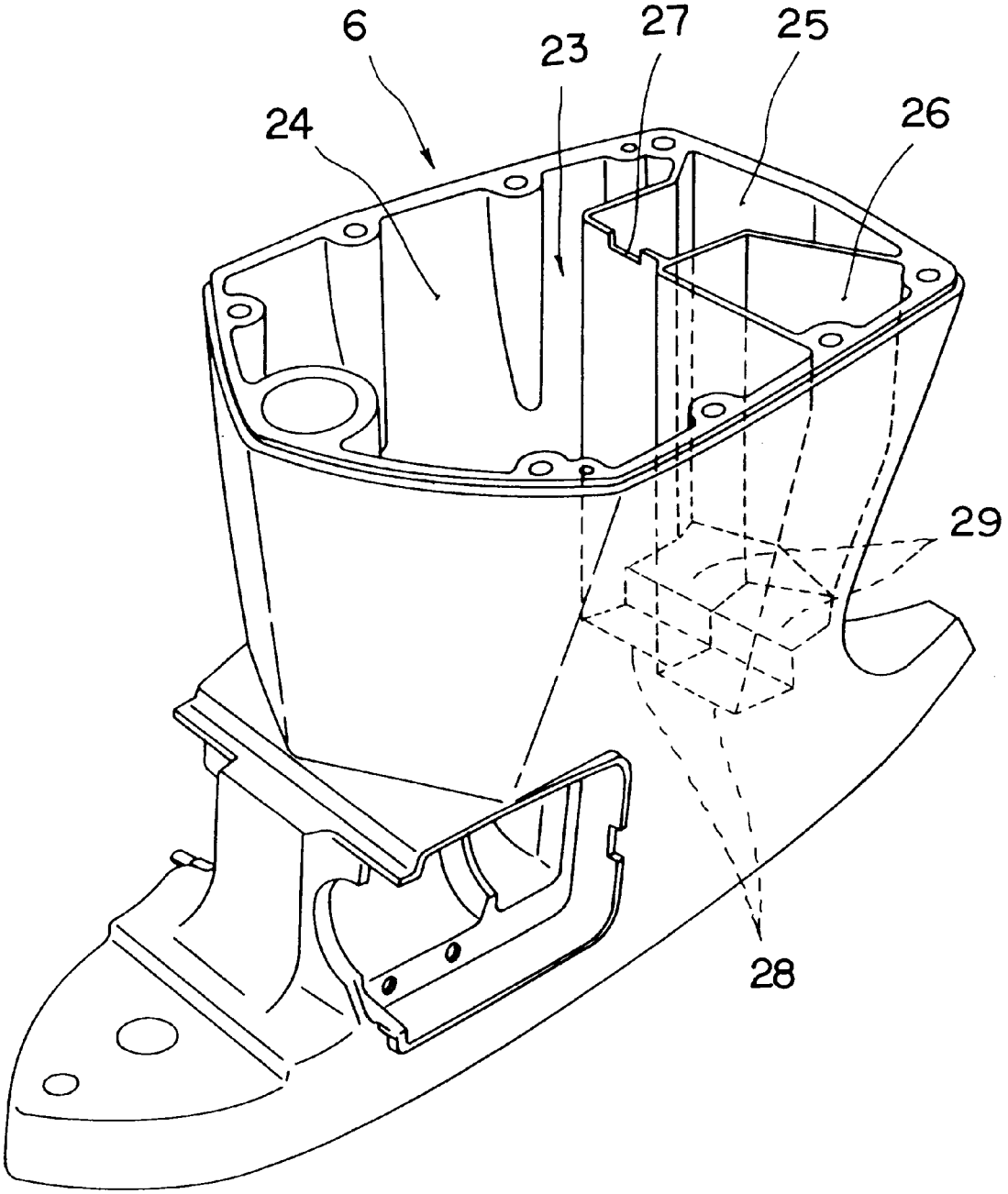
FIG. 6 is a perspective view showing a drive-shaft housing.

FIG. 6 is a perspective view showing the drive-shaft housing 6. As shown in FIGS. 2 and 6, a partition wall 23 is formed integrally with the inside portion of the drive-shaft housing 6. The partition wall 23 partitions the inside space of the drive-shaft housing 6 into a main expansion chamber 24, a release chamber 25, which also serves as an auxiliary expansion chamber and an overflow chamber 26. The top end of the partition wall 23 is in contact with the bottom of the oil pan 5. Further, a gap portion, preferably a cutout portion, 27 for communication is formed at an upper end portion of the partition wall 23 through which the main expansion chamber 24 and the release chamber 25 are communicated with each other.

An opening 28 opened in the main expansion chamber 24 is formed in the bottom portions of the release chamber 25 and the overflow chamber 26. Moreover, a stepped-portion 29 inclined downwards toward the opening 28 is formed at, for example, a position somewhat adjacent to the central portion in the release chamber 25 and the overflow chamber 26.

The main expansion chamber 24 is communicated with the exhaust passage 20 in the oil pan 5, and the exhaust release passage 21 is communicated with the exhaust release passage 21 in the oil pan 5. The overflow chamber 26 is also communicated with the downstream portion of a pressure valve, not shown, disposed at an intermediate position of the cooling-water supply passage 18.

Alternate long and short dash line A shown in FIG. 2 indicates the water level in the drive-shaft housing 6 which varies in an elapse of time from stoppage of the engine 3 to low-speed revolution of the engine 3. Alternate long and short dash line B indicates the water level which is realized when the revolution of the engine 3 has been raised to an intermediate speed or higher.

The operation of this embodiment will be described.

When the engine 3 has been started, an exhaust gas is introduced into the main expansion chamber 24 in the drive-shaft housing 6 through the exhaust passage 20 in the oil pan 5, and an exhaust cooling water, which has cooled the portions of the engine 3, is allowed to pass through the cooling-water discharge passage 19 in the oil pan 5 and then introduced into the main expansion chamber 24 in the drive-shaft housing 6.

When the number of revolutions of the engine 3 is low because of, for example, idling, the pressure of the exhaust gas is too low to sufficiently downwards push sea water as indicated with water level A. Therefore, the exhaust gas is subjected to noise and pressure reduction in the main expansion chamber 24 and then introduced from the cutout portion 27 for communication into the release chamber 25 in which the exhaust gas is furthermore subjected to noise and pressure reduction. Then, the exhaust gas is allowed to pass through the exhaust release passage 21 and then discharged to the outside portion of the outboard motor 1 through the upper exhaust-gas discharge port 22.

Exhaust cooling water mixed with the exhaust gas in the main expansion chamber 24 is separated from the exhaust gas in the release chamber 25. Then, exhaust cooling water flows through the stepped portion 29 and is then introduced through the opening 28 into the main expansion chamber 24. Since the stepped portion 29 is inclined, exhaust cooling water mixed with the exhaust gas always flows downwards even during the usual operation, horizontal steering or tilting up of the outboard motor 1. Therefore, a backflow of the exhaust cooling water together with the exhaust gas in the exhaust passage 20 can be prevented.

Since the partition wall 23 is integrally formed with the inside portion of the drive-shaft housing 6 to partition or divide the inside portion into the main expansion chamber 24 and the release chamber 25, the exhaust tube which has been required for the conventional structure, can be omitted. As a result, the number of elements can be reduced and apprehension that the parts are broken because of corrosion can satisfactorily be decreased.

Since a great capacity can be provided for the exhaust passage as compared with the conventional structure in which the individual exhaust tube is disposed in the drive-shaft housing 6, the effect of reducing noise can be improved.

It is to be noted that the present invention is not limited to the described embodiment and many other changes and modifications may be made without departing from the scopes of the appended claims.

What is claimed is:

1. An outboard motor comprising an engine holder to be mounted to a hull, an engine disposed in an upper portion of the engine holder in a mounted state thereof, an oil pan disposed in a lower portion of the engine holder, and a drive-shaft housing disposed below the oil pan and adapted to house a drive shaft of the engine, in which an exhaust gas from the engine is guided to the drive-shaft housing through an exhaust gas passage and the exhaust gas in the drive-shaft housing is discharged outward through an exhaust release passage connected to the drive-shaft housing at a time of low-speed revolution of the engine, wherein a partition wall is formed integrally with an inside portion of the drive-shaft housing so as to divide the inside thereof into an expansion chamber communicated with the exhaust gas passage and a release chamber communicated with the exhaust release passage, said partition wall having an upper end portion, through which said expansion chamber and said release chamber are communicated with each other and wherein said release chamber is formed with an opening at a bottom portion thereof opened to the expansion chamber and a stepped portion inclined toward said opening is formed in said release chamber.

2. An outboard motor according to claim 1, wherein the upper end portion of said partition wall is formed with a cutout through which said expansion chamber and said release chamber are communicated with each other.

3. An outboard motor according to claim 1, wherein the upper end portion of the partition wall abuts against a bottom portion of the oil pan.

4. An outboard motor according to claim 1, wherein said low-speed revolution of the engine is in an engine idling operation time.

5. An outboard motor comprising an engine holder to be mounted to a hull, an engine disposed in an upper portion of the engine holder in a mounted state thereof, an oil pan disposed in a lower portion of the engine holder, and a drive-shaft housing disposed below the oil pan and adapted to house a drive shaft of the engine, in which an exhaust gas from the engine is guided to the drive-shaft housing through an exhaust gas passage and the exhaust gas in the drive-shaft housing is discharged outward through an exhaust release passage connected to the drive-shaft housing at a time of low-speed revolution of the engine, wherein a partition wall means is formed integrally with an inside portion of the drive-shaft housing so as to divide the inside thereof into a main expansion chamber communicated with the exhaust gas passage, a release chamber, as an auxiliary expansion chamber, communicated with the exhaust release passage, and an overflow chamber, said partition wall means having an upper end portion, through which said main expansion chamber and said release chamber are communicated with each other, and wherein said release chamber and said overflow chamber are formed with openings at bottom portions thereof opened to the expansion chamber and stepped portions inclined towards said openings are formed in said release chamber and said overflow chamber.

6. An outboard motor according to claim 5, wherein the upper end portion of said partition wall means is formed with a cutout through which said expansion chamber and said release chamber are communicated with each other.

* * * * *

UNITED STATES PATENT AND TRADEMARK OFFICE

CERTIFICATE OF CORRECTION

PATENT NO. : 6,036,558
DATED : March 14, 2000
INVENTORS : Takuya SATO et al.

It is certified that error appears in the above-identified patent and that said Letters Patent is hereby corrected as shown below:

In Claim 1, column 5, line 17, after "other", insert --,--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*